US010321224B2

(12) United States Patent
Li et al.

(10) Patent No.: US 10,321,224 B2
(45) Date of Patent: Jun. 11, 2019

(54) LOUDSPEAKER

(71) Applicant: GOERTEK INC., WeiFang (CN)

(72) Inventors: Zhaopeng Li, WeiFang (CN); Huawei Liu, WeiFang (CN); Xueping Song, WeiFang (CN)

(73) Assignee: GOERTEK INC., Weifang (CN)

( * ) Notice: Subject to any disclaimer, the term of this patent is extended or adjusted under 35 U.S.C. 154(b) by 2 days.

(21) Appl. No.: 15/738,076

(22) PCT Filed: Dec. 21, 2015

(86) PCT No.: PCT/CN2015/098052

§ 371 (c)(1),
(2) Date: Dec. 19, 2017

(87) PCT Pub. No.: WO2017/016151

PCT Pub. Date: Feb. 2, 2017

(65) Prior Publication Data

US 2018/0310094 A1 Oct. 25, 2018

(30) Foreign Application Priority Data

Jul. 30, 2015 (CN) ..... 2015 2 0564389 U

(51) Int. Cl.
*H04R 1/02* (2006.01)
*H04R 1/28* (2006.01)
(Continued)

(52) U.S. Cl.
CPC ..... *H04R 1/2876* (2013.01); *H04R 1/025* (2013.01); *H04R 7/18* (2013.01); *H04R 9/025* (2013.01); *H04R 9/06* (2013.01)

(58) Field of Classification Search
CPC ..... H04R 1/2876; H04R 1/025; H04R 7/18; H04R 9/025
(Continued)

(56) References Cited

U.S. PATENT DOCUMENTS 8,605,919 B2 * 12/2013 Awamura ..... H04R 31/006 381/174
9,035,513 B2 * 5/2015 Funaki ..... H04R 7/18 310/12.16
(Continued)

FOREIGN PATENT DOCUMENTS

CN 102474688 A 5/2012
CN 202496060 U 10/2012
(Continued)

OTHER PUBLICATIONS

International Search Report for International Patent Application No. PCT/CN2015/098052, filed on Dec. 21, 2015.

*Primary Examiner* — Sean H Nguyen

(57) ABSTRACT

Disclosed is a loudspeaker, comprising a casing (7) and a vibration system. The vibration system comprises a vibrating diaphragm (3) and a sound coil (4) fixed at a side of the vibrating diaphragm. A joint portion is arranged at an edge of the vibrating diaphragm (3). The joint portion is bonded and fixed to the casing (7). A recessed adhesive accommodating structure (71) is arranged at an end face connecting the casing (7) to the joint portion. The adhesive accommodating structure (71) is arranged corresponding to an adhesive surface between the vibrating diaphragm (3) and the casing (7), and is an annular structure. According to the present invention, the loudspeaker's acoustic performance is stabilized, while the vibrating diaphragm (3) and the casing (7) can be firmly connected to each other.

10 Claims, 3 Drawing Sheets

(51) Int. Cl.
*H04R 7/18* (2006.01)
*H04R 9/02* (2006.01)
*H04R 9/06* (2006.01)

(58) Field of Classification Search
USPC ..... 381/353
See application file for complete search history.

(56) References Cited

U.S. PATENT DOCUMENTS

| | | | | |
|---|---|---|---|---|
| 2006/0140439 | A1* | 6/2006 | Nakagawa | H04M 1/0266 381/431 |
| 2009/0245565 | A1* | 10/2009 | Mittleman | H04M 1/035 381/365 |
| 2011/0135141 | A1* | 6/2011 | Tanabe | H04R 9/025 381/413 |
| 2012/0064845 | A1* | 3/2012 | Smith | H04M 1/05 455/90.2 |
| 2014/0205128 | A1* | 7/2014 | Spoettl | H04R 3/00 381/369 |

FOREIGN PATENT DOCUMENTS

| | | | |
|---|---|---|---|
| CN | 204291376 | U | 4/2015 |
| CN | 204408623 | U | 6/2015 |
| EP | 1 651 004 | A2 | 4/2006 |
| JP | 58-54200 | U | 4/1983 |

* cited by examiner

LOUDSPEAKER

CROSS-REFERENCE TO RELATED APPLICATIONS

The present specification is a U.S. National Stage of International Patent Application No. PCT/CN2015/098052 filed Dec. 21, 2015, which claims priority to and the benefit of Chinese Patent Application No. 201520564389.2 filed in the Chinese Intellectual Property Office on Jul. 30, 2015, the entire contents of which are incorporated herein by reference.

TECHNICAL FIELD

The present invention relates to the technical field of electroacoustic transducing, more specifically, to a loudspeaker.

BACKGROUND ART

At present, the vibrating diaphragm of the loudspeaker unit is mainly fixedly bonded to the housing by adhesive. As the size of the loudspeaker per se is small, the gluing band for the vibrating diaphragm is relatively narrow when the vibrating diaphragm is fixedly bonded to the housing by adhesive, and the mount of adhesive at the position where the vibrating diaphragm is bonded to the housing must be strictly controlled due to the impact of the fluidity of the adhesive per se. If excessive adhesive is applied, the adhesive will overflow to the vibrating diaphragm, which may affect the acoustic performance of the loudspeaker. If insufficient adhesive is applied, it is possible to cause broken adhesive, so that the bonding strength between the vibrating diaphragm and the housing becomes deteriorative. In addition, in the case where the loudspeaker unit is not provided with a front cover, the deterioration of the bonding strength between the vibrating diaphragm and the housing may also directly affect the mass production of the entire loudspeaker module.

Therefore, there is a need for a loudspeaker to ensure that the acoustic performance of the loudspeaker is stable while the vibrating diaphragm is firmly bonded to the housing.

SUMMARY

In view of the above problems, it is an object of the present invention to provide a loudspeaker to solve the following problem that when the vibrating diaphragm is bonded and fixed to the housing by adhesive in prior art, if excessive adhesive is applied, the adhesive will overflow to the vibrating diaphragm, which may affect the acoustic performance of the loudspeaker, however, if insufficient adhesive is applied, it is possible to cause broken adhesive, so that the bonding strength between the vibrating diaphragm and the housing becomes deteriorative.

The loudspeaker provided by the present invention comprises a housing and a vibration system. The vibration system comprises a vibrating diaphragm and a voice coil fixed at a side of the vibrating diaphragm, wherein a joint portion is provided at an edge of the vibrating diaphragm. The joint portion is bonded and fixed to the housing. A recessed adhesive accommodating structure is provided at an end surface of the housing which is connected with the joint portion. The adhesive accommodating structure is provided at a position corresponding to a bonding surface of the vibrating diaphragm which is bonded to the housing, and the adhesive accommodating structure is an annular structure.

In addition, it is preferable that the joint portion of the vibrating diaphragm is bonded and fixed to a sidewall of the housing, and the adhesive accommodating structure is provided at a surface of the sidewall of the housing.

In addition, it is preferable that the adhesive accommodating structure is a structure in which the surface of the sidewall of the housing is recessed towards a side away from the vibrating diaphragm.

In addition, it is preferable that the adhesive accommodating structure is a structure formed by removing material from the housing, and a cross section of the adhesive accommodating structure is arc-shaped.

In addition, it is preferable that the adhesive accommodating structure is provided along the sidewall of the housing, and avoids positioning pillars at corners of the housing.

In addition, it is preferable that the loudspeaker further comprises a front cover coupled with the housing; the front cover is provided with another adhesive accommodating structure, that is a first adhesive accommodating portion, at a position where the front cover is fixedly connected with the vibrating diaphragm; and the adhesive accommodating structure provided on the sidewall of the housing is a second adhesive accommodating portion.

In addition, it is preferable that the front cover is located on an upper side of the vibrating diaphragm and is bonded and fixed to the vibrating diaphragm by adhesive, and the housing is bonded to a lower side of the vibrating diaphragm and is fixed to the joint portion by adhesive.

In addition, it is preferable that the loudspeaker further comprises a magnetic circuit system accommodated in the housing, and the magnetic circuit system comprises a magnetic conductive yoke fixedly connected with the housing, a magnet provided at a center position of the magnetic conductive yoke, and a washer provided on one side of the magnet away from the magnetic conductive yoke.

In addition, it is preferable that a magnetic gap is formed between the magnet and a sidewall of the magnetic conductive yoke, and the voice coil is suspended in the magnetic gap.

In addition, it is preferable that a sound hole is provided on the housing, and a damping mesh is attached to a surface of the sound hole.

According to the above technical solutions, in the loudspeaker according to the present invention, an adhesive accommodating structure is provided on the housing of the loudspeaker to increase the area of the coated adhesive, to improve the bonding strength between the vibrating diaphragm and the housing, and to reduce the probability of broken adhesive. At the same time, the amount of the coated adhesive and the bonding area are increased, which may ensure firm connection between the vibrating diaphragm and the housing, and excess adhesive may be accommodated by the adhesive accommodating structure, which may effectively prevent the adhesive from overflowing to the vibrating diaphragm, so as to ensure the quality of the loudspeaker. In addition, in the loudspeaker of the present invention, the adhesive accommodating structure may be provided on the front cover simultaneously to enhance the bonding strength between the front cover and the vibrating diaphragm and prevent overflowing of the adhesive.

In order to achieve the above and other related objectives, one or more aspects of the present invention comprise those features to be described in detail in the followings and particularly pointed out in claims. The following descriptions and accompanying drawings describe in detail certain illustrative aspects of the present invention. However, these aspects only illustrate some of the ways in which the principle of the present invention can be used. In addition, the present invention intends to comprise all these aspects and their equivalents.

BRIEF DESCRIPTION OF DRAWINGS

By referring to the descriptions in connection with the accompanying drawings and the contents of the claims, and with a full understanding of the present invention, other purposes and results of the present invention will be more clearly and easily understand. In the drawings:

Figure 1:
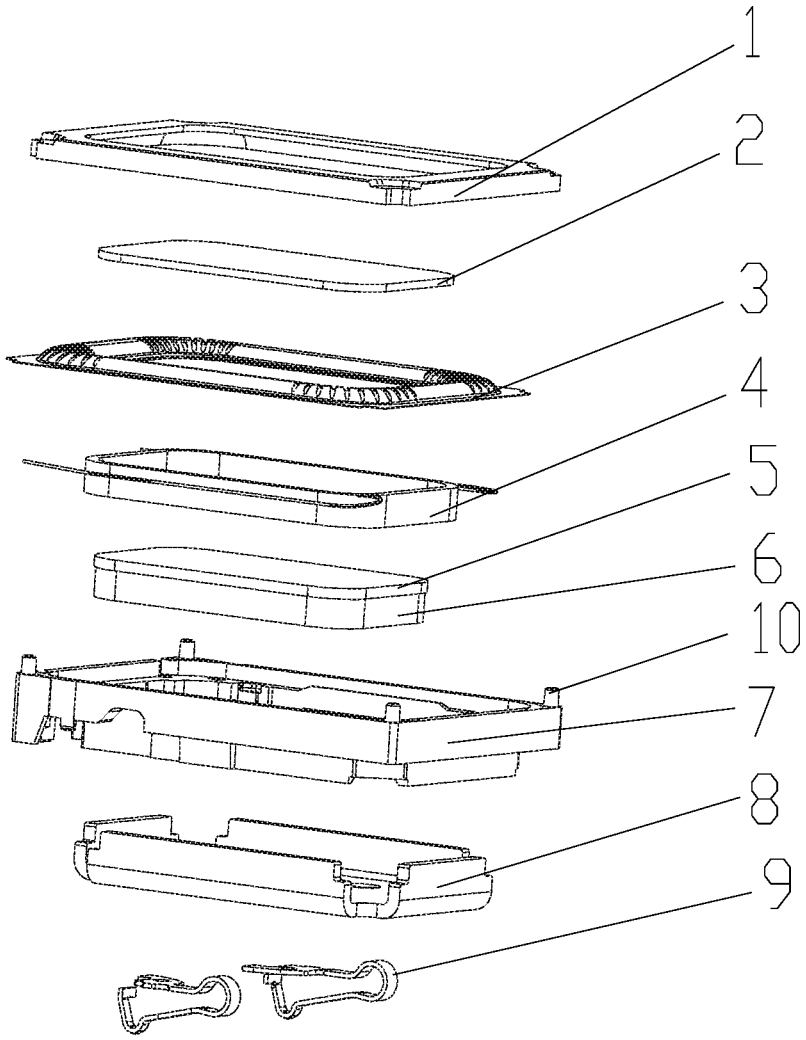
FIG. 1 is an exploded structural representation of the loudspeaker according to the embodiment of the present invention.

In the drawings: front cover 1; first adhesive accommodating portion 11; reinforcing portion 2; vibrating diaphragm 3; voice coil 4; washer 5; magnet 6; housing 7; second adhesive accommodating portion 71; magnetic conductive yoke 8; elastic sheet 9; positioning pillar 10.

Same reference numerals in all of the accompanying drawings indicate similar or corresponding features or functions.

DETAILED DESCRIPTION OF EMBODIMENTS

In view of the abovementioned problems, i.e., the mount of adhesive is difficult to be controlled when the vibrating diaphragm of the loudspeaker is fixedly bonded to the housing by adhesive, if excessive adhesive is applied, the adhesive will overflow to the vibrating diaphragm, which may affect the acoustic performance of the loudspeaker, however, if insufficient adhesive is applied, it is possible to cause broken adhesive, so that the bonding strength between the vibrating diaphragm and the housing becomes deteriorative and the quality of the loudspeaker cannot be ensured, in the present invention, the housing is provided with an adhesive accommodating structure at the position where the housing is fixedly connected with the vibrating diaphragm, and the adhesive fixedly connecting the vibrating diaphragm and the housing is accommodated in the adhesive accommodating structure, which not only may increase the amount of adhesive to ensure a firm bonding between the vibrating diaphragm and the housing, but also may avoid adhesive overflow, thereby ensuring the acoustic performance of the loudspeaker.

In order to describe the structure of the loudspeaker of the embodiments of the present invention in details, hereinafter, particular embodiments of the present invention are described in connection with the accompanying drawings.

Figure 2:
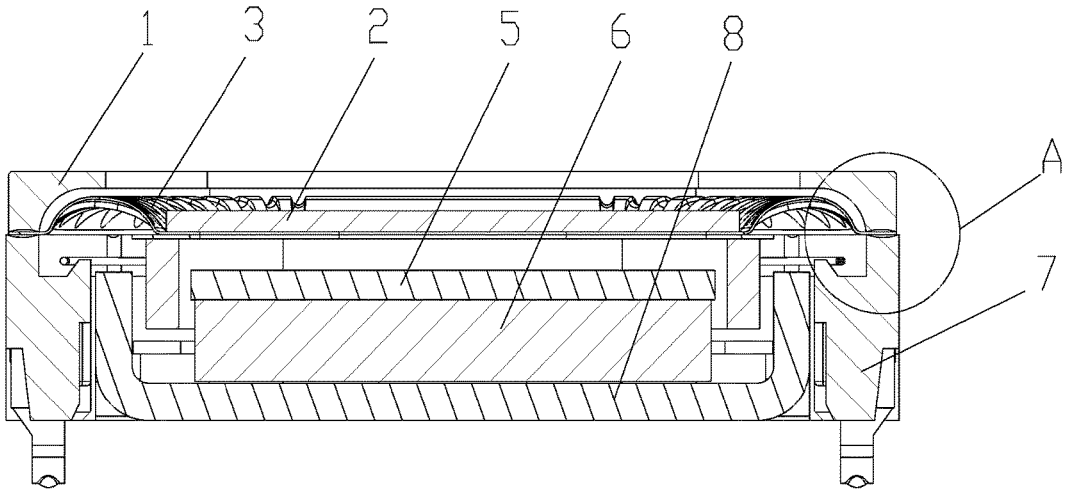
FIG. 2 is a schematic cross-sectional view of the loudspeaker according to the embodiment of the present invention.
Figure 3:
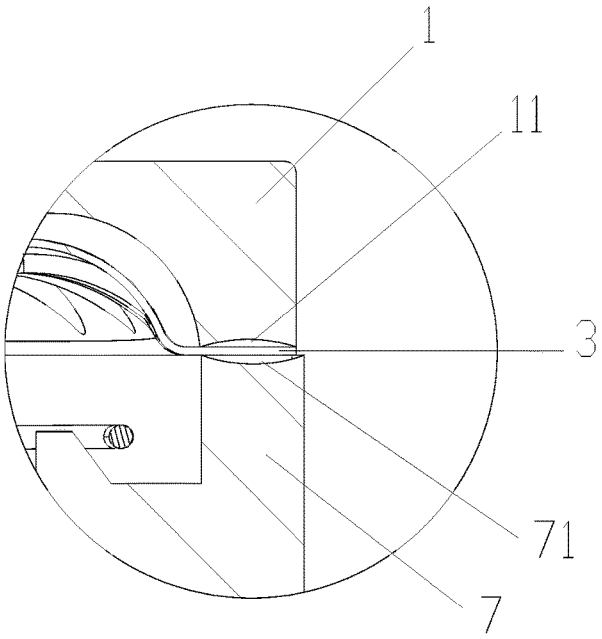
FIG. 3 is a partial enlarged view of part A in FIG. 2.

FIG. 1 is an exploded structure of the loudspeaker according to the embodiment of the present invention, FIG. 2 is a cross-sectional view of the loudspeaker according to the embodiment of the present invention, and FIG. 3 is an enlarged structure of part A in FIG. 2.

As shown in FIGS. 1 to 3, the loudspeaker of the embodiment of the present invention comprises a housing 7 and a vibration system. The vibration system comprises a voice coil 4 and a vibrating diaphragm 3 fixed at a side of the voice coil 4. The housing 7 is provided with an adhesive accommodating structure at a position where the housing 7 is connected with the vibrating diaphragm 3, so as to improve the bonding force between the vibrating diaphragm 3 and the housing 7 and prevent adhesive from overflowing to the vibrating diaphragm 3. When the vibrating diaphragm 3 is fixed to the housing 7 by adhesive, the adhesive for fixedly connecting the vibrating diaphragm 3 and the housing 7 is accommodated in the adhesive accommodating structure.

Wherein, a joint portion is provided at the edge of the vibrating diaphragm 3, and the joint portion of the vibrating diaphragm 3 is bonded and fixed to the housing 7. A recessed adhesive accommodating structure is provided at an end surface of the housing 7 which is connected with the joint portion. The adhesive accommodating structure is provided at a position opposite to a bonding surface of the vibrating diaphragm 3 which is bonded to the housing 7, and the adhesive accommodating structure is an annular structure surrounding the sidewall of the housing 7.

Particularly, the joint portion of the vibrating diaphragm 3 is bonded and fixed to the sidewall of the housing 7, and the adhesive accommodating structure is provided at the surface of the sidewall of the housing 7. In other words, the adhesive accommodating structure is a structure in which the surface of the sidewall of the housing 7 is recessed towards a side away from the vibrating diaphragm 3 and is formed by removing material, and its cross section may have a curved shape or other shapes. In addition, the adhesive accommodating structure is provided along the sidewall of the housing 7, and avoids the positioning pillars 10 at the corners of the housing 7.

In a particular embodiment of the present invention, the housing of the loudspeaker further comprises a front cover 1 which is coupled with the housing 7, and the vibration system is accommodated in the cavity formed by the front cover 1 and the housing 7, wherein the vibration system comprises a vibrating diaphragm 3, a voice coil 4 fixed at one side of the vibrating diaphragm 3, and a reinforcing portion 2 fixed to the center position of the vibrating diaphragm 3. The vibrating diaphragm 3 comprises a joint portion (located at the outermost periphery of the vibrating diaphragm) fixedly connected with the housing 7, a suspension ring portion with a concave/convex structure which is integrally formed with the joint portion, and a plane part (located at the innermost part of the vibrating diaphragm) provided inside the suspension ring portion, the reinforcing portion 2 is provided on the plane part of the vibrating diaphragm, and mainly used for adjusting the acoustic performance of the loudspeaker. In order to reduce the overall mass of the vibration system, the material of the plane part of the vibrating diaphragm located at a position corresponding to the reinforcing portion 2 is typically removed, and the reinforcing portion 2 covers the position of the removed material.

In the above embodiment, adhesive accommodating structures may be provided at both the front cover 1 and the housing 7 correspondingly. Specifically, the front cover 1 is bonded to the upper side of the vibrating diaphragm 3 and fixed to the vibrating diaphragm 3 by adhesive. The housing 7 is bonded to the lower side of the vibrating diaphragm 3 and fixed to the joint portion by adhesive as well. The front cover 1 is provided with an adhesive accommodating structure at a position where the front cover 1 is fixedly connected with the vibrating diaphragm 3, and the adhesive accommodating structure is defined as a first adhesive accommodating portion 11. The housing 7 is provided with a second adhesive accommodating portion 71 corresponding to the first adhesive accommodating portion 11 at a position where the housing 7 is fixedly connected with the vibrating diaphragm 3, that is, the adhesive accommodating structure provided on the sidewall of the housing 7 is defined as the second adhesive accommodating portion 71. At this time, the adhesive for bonding and fixing the vibrating diaphragm 3 is accommodated in the first adhesive accommodating portion 11 and the second adhesive accommodating portion 71 located at two sides of the vibrating diaphragm 3. By providing the first adhesive accommodating portion 11 and the second adhesive accommodating portion 71, it is possible to increase the amount of the coated adhesive for the vibrating diaphragm 3, ensure firm connection between the vibrating diaphragm 3 and the front cover 1 as well as the housing 7, and prevent excessive adhesive from overflowing to the vibrating diaphragm 3, thereby improving the yield of the loudspeaker and ensuring the reliability of the loudspeaker unit.

In another embodiment of the present invention, the adhesive accommodating structure may be an arcuate groove or a trapezoidal recessed structure. It should be noted that the purpose of the present invention is to increase the coating area and the bonding strength, and ensure the performance of the product. Thus, similar improvements or other shapes of the adhesive accommodating structure may fall into the scope of the present invention without being specifically limited thereto.

Figure 4:
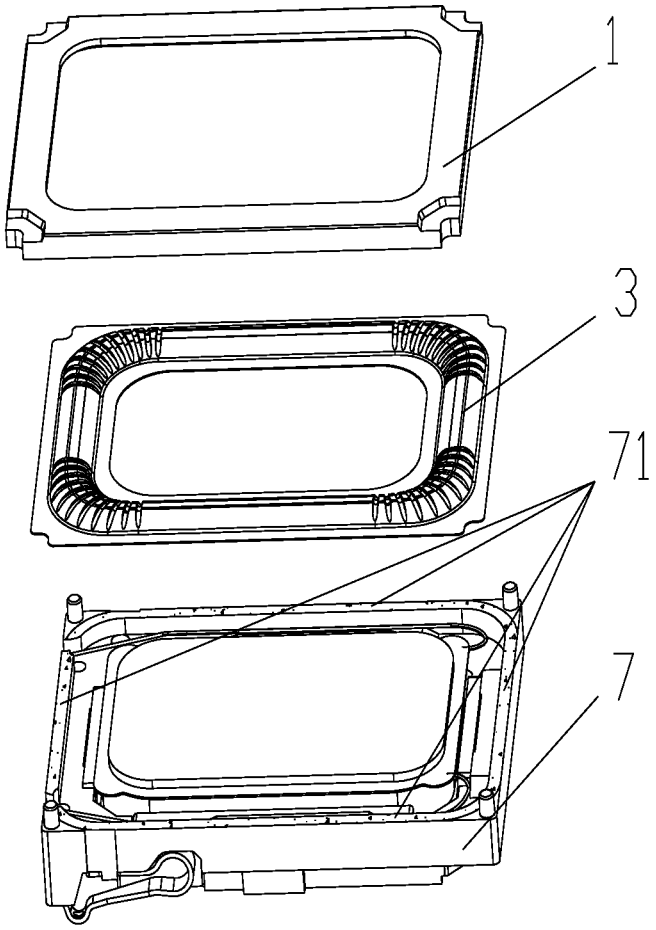
FIG. 4 is a schematic structure view illustrating the adhesive accommodating structure of the loudspeaker according to the embodiment of the present invention.

Particularly, FIG. 4 illustrates the adhesive accommodating structure of the loudspeaker according to the embodiment of the present invention.

In connection with FIGS. 1 to 4, in a specific embodiment of the present invention, the housing 7 is provided with a gluing band at a position where the housing 7 is fixedly connected with the vibrating diaphragm 3. In the process of bonding and fixing the vibrating diaphragm 3 by adhesive, the adhesive is applied to the gluing band of the housing 7, and the vibrating diaphragm 3 is bonded and fixed to the gluing band. In order to increase the width of the adhesive area of the vibrating diaphragm 3 so as to ensure the bonding strength between the vibrating diaphragm 3 and the housing 7, a groove-like adhesive accommodating structure (i.e., the second adhesive accommodating portion 71) is provided at the position of the gluing band of the housing 7, and the adhesive for fixing the vibrating diaphragm 3 is accommodated in the adhesive accommodating structure so as to prevent excessive adhesive from overflowing and affecting the performance of the loudspeaker.

In the present invention, the front cover 1 may be provided with a groove-like adhesive accommodating structure (i.e., the first adhesive accommodating portion 11) at the position opposite to the gluing band of the housing 7. The first adhesive accommodating portion 11 and the second adhesive accommodating portion 71 are correspondingly provided at the upper and lower sides of the vibrating diaphragm 3, respectively. In the process of bonding and fixing the front cover 1 and the vibrating diaphragm 3, the adhesive accommodating structure can ensure stable performance of the loudspeaker and prolong the service life of the loudspeaker while ensuring that the vibrating diaphragm 3 is firmly connected with the front cover 1 and the housing 7, respectively.

In addition, a magnetic circuit system is also accommodated in the cavity formed by the front cover 1 and the housing 7, wherein the magnetic circuit system comprises a magnetic conductive yoke 8 fixedly connected with the housing 7, a magnet 6 provided at the center position of the magnetic conductive yoke 8, and a washer 5 provided at one side of the magnet 6 away from the magnetic conductive yoke 8. Wherein the magnetic gap is formed between the magnet 6 along with the washer 5 and the sidewalls of the magnetic conductive yoke 8, and the voice coil 4 is suspended in the magnetic gap. The magnetic conductive yoke 8 is fixed to the housing 7, and the vibration system, the magnet 6, and the washer 5 are accommodated in the cavity formed by the front cover 1 and the housing 7. The washer 5, the magnet 6 and the magnetic conductive yoke 8 are successively fixed and connected to one another from above to below. The magnetic conductive yoke 8 is mainly used for fixing the magnet 6 and correcting the magnetic lines of force, and comprises a rectangular bottom and four sidewalls which are provided perpendicularly to the bottom. The magnetic gap is formed between the magnet 6 along with the washer 5 and the sidewalls of the magnetic conductive yoke 8, and the voice coil 4 is suspended in the magnetic gap.

It should be noted that the loudspeaker of the embodiment of the present invention further comprises an elastic sheet 9 for connecting the loudspeaker unit and the external circuit, and a sound hole. Wherein, the sound hole is provided on the housing, and a damping mesh is attached to the surface of the sound hole. The damping mesh is used for preventing particulate pollutants in the air from entering into the interior of the loudspeaker, and may also avoid direct impact of airflow on the vibrating diaphragm, so as to ensure the sound quality and acoustic performance of the loudspeaker during application.

According to the above-described embodiments, it can be seen that in the loudspeaker provided by the present invention, the groove-like adhesive accommodating structure is provided in the gluing band for connecting the housing and the vibrating diaphragm, which not only can increase the gluing area, increase the amount of the coated adhesive, and reduce the probability of broken adhesive, but also can ensure the bonding strength between the vibrating diaphragm and the housing, avoid excess adhesive from overflowing to the vibrating diaphragm and ensure the acoustic performance of the loudspeaker.

As described above, the loudspeaker provided by the present invention is described by way of example with reference to the accompanying drawings. However, it should be understood by those skilled in the art that various improvements can be made to the loudspeaker provided by the present invention as described above without departing from the contents of the present invention. Accordingly, the scope of protection of the present invention is determined by the contents of the appended claims.

The invention claimed is:

1. A loudspeaker, comprising a housing and a vibration system, wherein the vibration system comprises a vibrating diaphragm and a voice coil fixed at a side of the vibrating diaphragm, wherein a joint portion is provided at an edge of the vibrating diaphragm;

the joint portion is bonded and fixed to the housing;

a second adhesive accommodating portion is provided as a recess at an end surface of the housing which is connected with the joint portion;

a front cover with a first adhesive accommodating portion is coupled with the housing at a position where the front cover is fixedly connected with the vibrating diaphragm; and an adhesive accommodating structure comprising the first and second adhesive accommodating portions is provided at a position corresponding to a bonding surface of the vibrating diaphragm which is bonded to the housing, and the adhesive accommodating structure is an annular structure.

2. The loudspeaker according to claim 1, wherein the joint portion of the vibrating diaphragm is bonded and fixed to a sidewall of the housing; and the adhesive accommodating structure is provided at a surface of the sidewall of the housing.

3. The loudspeaker according to claim 2, wherein the adhesive accommodating structure is a structure in which the surface of the sidewall of the housing is recessed towards a side away from the vibrating diaphragm.

4. The loudspeaker according to claim 3, wherein the adhesive accommodating structure is a structure formed by removing material from the housing; and a cross section of the adhesive accommodating structure is arc-shaped.

5. The loudspeaker according to claim 4, wherein the adhesive accommodating structure is provided along the sidewall of the housing, and avoids positioning pillars at corners of the housing.

6. The loudspeaker according to claim 1, wherein the front cover is located on an upper side of the vibrating diaphragm and is bonded and fixed to the vibrating diaphragm by adhesive; and the housing is bonded to a lower side of the vibrating diaphragm and is fixed to the joint portion by adhesive.

7. The loudspeaker according to claim 1, further comprising a magnetic circuit system accommodated in the housing, wherein the magnetic circuit system comprises a magnetic conductive yoke fixedly connected with the housing, a magnet provided at a center position of the magnetic conductive yoke, and a washer provided on one side of the magnet away from the magnetic conductive yoke.

8. The loudspeaker according to claim 7, wherein a magnetic gap is formed between the magnet and a sidewall of the magnetic conductive yoke, and the voice coil is suspended in the magnetic gap.

9. The loudspeaker according to claim 1, wherein a sound hole is provided on the housing; and a damping mesh is attached to a surface of the sound hole.

10. The loudspeaker according to claim 1, wherein the vibrating diaphragm is sandwiched between first and second accommodating portions.

* * * * *